United States Patent [19]

Smith

[11] Patent Number: 4,750,737

[45] Date of Patent: Jun. 14, 1988

[54] BICYCLE TRAINING AND EXERCISE DEVICE

[76] Inventor: Sebie B. Smith, 1252 Peachtree St., Montgomery, Ala. 36106

[21] Appl. No.: 890,416

[22] Filed: Jul. 29, 1986

[51] Int. Cl.[4] ..... A63B 69/16; A63B 23/06

[52] U.S. Cl. ..... 272/73; 434/61

[58] Field of Search ..... 272/73, 93, 143, 144, 272/DIG. 4; 248/436, 284; 211/17, 18, 22, 202; 434/61, 247

[56] References Cited

U.S. PATENT DOCUMENTS

| | | | |
|---|---|---|---|
| 719,186 | 1/1903 | Champ | 211/202 |
| 4,082,265 | 4/1978 | Berkes | 272/73 |
| 4,415,152 | 11/1983 | Smith | 272/73 |

FOREIGN PATENT DOCUMENTS

| | | | |
|---|---|---|---|
| 5611 | 4/1903 | Denmark | 272/73 |
| 99657 | 1/1898 | Fed. Rep. of Germany | 73/ |
| 7531 | of 1897 | United Kingdom | 272/73 |

*Primary Examiner*—Richard J. Apley
*Assistant Examiner*—S. R. Crow
*Attorney, Agent, or Firm*—Newton, Hopkins & Ormsby

[57] ABSTRACT

A bicycle training and exercise device for stationary operation of a bicycle thereon, the device having roller and beltway members forming a riding platform for the bicycle, and a plurality of lever arms for supporting the bicycle on the device. The lever arms of the bicycle are movable laterally in response to lateral movements of the bicycle. The pivotally joined lever arms provide substantial support for the bicycle and rider while closely simulating actual riding conditions.

17 Claims, 2 Drawing Sheets

BICYCLE TRAINING AND EXERCISE DEVICE

BACKGROUND OF THE INVENTION

Bicycles may be ridden indoors with the aid of a device such as that shown in my prior U.S. Pat. No. 4,415,152. The device works by transmitting the force developed at the powered wheel to a conveyor belt or the like, upon which the non-powered wheel travels. The bicycle used is generally of conventional type, the only difference being that the bicycle may be connected to a frame member, as shown in the above-mentioned patent, or it may be disconnected, taken off of the rollers, and ridden in a conventional manner.

The ability to ride the bicycle indoors provides several distinct advantages. The bicycle may be ridden, and thus, the pleasure and the exercise obtained, in any season and regardless of the weather. Such training devices also provide a safe location, as opposed to streets or sidewalks, for practicing either basic riding or advanced techniques. Thus, the device may be used by anyone from beginning riders to Olympic cyclists.

SUMMARY OF THE INVENTION

It is, therefore, one of the principal objects of the present invention to provide a bicycle training device that is safe and easy to use, being usable by children learning to ride a bicycle or by advanced riders for developing endurance and technique, and which is durable for providing a long service life.

Another object of the present invention is to provide a bicycle training device which securely engages the bicycle when in use, and from which the bicycle can be quickly and easily disconnected for normal riding outdoors.

A further object of the present invention is to accommodate a plurality of different sized bicycles with the present training device, and which device requires little maintenance and a relatively small area for operation.

These and additional objects are attained by the present invention which relates to a bicycle training and exercise device having a roller and belting means capable of receiving a bicycle for stationary operation thereon. The bicycle is supported by a plurality of lever arm means which are joined to stanchion means on each side of the bicycle and releasably joined to the bicycle. The lever arms are movable laterally with respect to one another in response to lateral movements of the bicycle.

The invention may be used with a plurality of different sized bicycles for closely simulating actual riding conditions. Substantial stability is provided for the rider while the device permits easy lateral movement or leaning by the rider.

Various additional objects and advantages will become apparent from the below description, with reference to the accompanying drawings.

DETAILED DESCRIPTION OF THE PREFERRED EMBODIMENT

Figure 1:
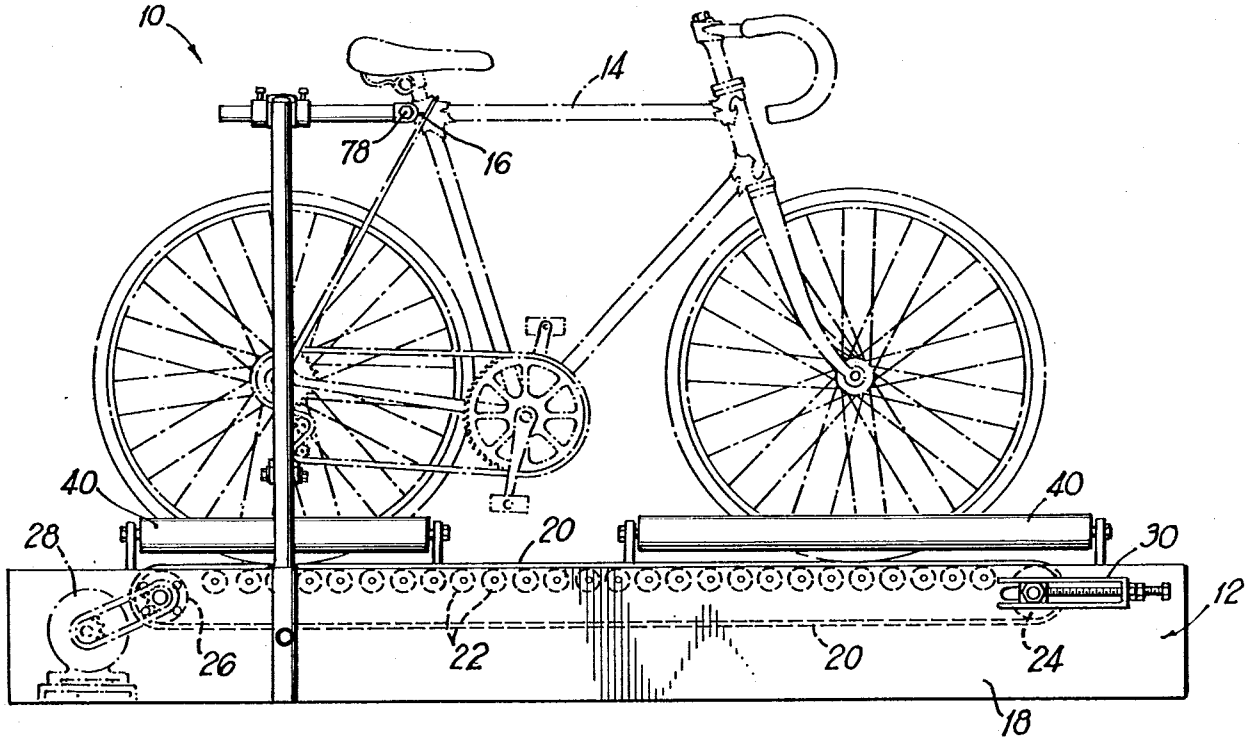
FIG. 1 is a schematic, side elevational view of the present bicycle training and exercise device, the roller assembly and bicycle being shown in broken lines.

Referring now more specifically to the drawings, and to FIG. 1 in particular, numeral 10 designates generally the support means of the present invention whereby the bicycle is supported in a generally upright or riding position on the horizontal, moving beltway 12. Shown attached to the support means is a bicycle 14 which is conventional in most respects, the only difference being the addition of a connecting bracket 16 located near the bicycle seat mounting, by which the bicycle is connected to the present bicycle training device. The addition of bracket 16 is the only modification required to equip the bicycle for use with the present device, thus, any size or type of bicycle may be used. The device stabilizes the bicycle, not allowing longitudinal movement, but permitting free lateral and vertical movement within the confines of the beltway.

The horizontal moving beltway includes a generally hollow elongated base 18 having a horizontal top wall and being adapted to rest on a level surface. Extending longitudinally of the base for a major portion of its length is an endless belt 20, supported by a plurality of closely spaced rollers 22 beneath the top run of the belt. The belt is trained over front and rear guide rollers 24 and 26, respectively, with the rear roller capable of accepting a variable speed drive motor 28, indicated by phantom lines in FIG. 1. The tension of the belt 20 can be adjusted by means of a tensioning device 30, which is secured to the front guide roller 24. The base member and beltway may also be provided as shown in my prior U.S. Pat. No. 4,415,152 and such a construction is hereby incorporated by reference. As shown, the forward portion comprises a movable beltway while the rearward portion has two parallel rollers which cradle the driving wheel of the bicycle and transfer the generated force to the beltway.

The belt 20 projects through an opening in the top surface of the base 18 and is essentially flush with or slightly above the top wall of the base. Lateral guard means, such as rollers 40 are mounted on base 18 near the front and rear portions thereof in the vicinity of the front and rear wheels of the bicycle, to restrain movement of the wheels of the bicycle in lateral directions within the confines of the beltway.

As noted, the rear of the bicycle is supported by a support means 10. The support means are in the form of lever arm means and include right and left, generally vertical stanchions 42. The stanchions are adjustable vertically, being received within elongated collars 44 and secured therein by means of a set screw arrangement 46. This allows the support means 10 to be adjusted vertically to accommodate different bicycle sizes. The stanchions have U-shaped support brackets 48, secured near the upper end thereof in a suitable manner as by welding. Descending downwardly and generally angularly from the support brackets 48 is a bar or pipe 50. The upper end of bar 50 is formed as or has secured thereto a bearing means 52, such as, for example, a self-aligning pillow block, the bearing means shown here serving only as an example, and is secured within bracket 48 with suitable means such as bolts 54 and nuts 56. The bearing means is rotatable and pivotable therein through a limited range. Secured near the bottom of bar 50, as by welding, is another generally U-shaped support bracket 58.

Ascending generally angularly from bracket 58 is a second pipe means or bar 60, bars 50 and 60 forming a generally V-shaped arrangement. The lower end of bar 60 is formed as a bearing means 62, which is also preferably a self-aligning type of bearing, and which is journaled for limited rotation in bracket 58, being secured therein in a suitable manner, such as with bolts 54 and nuts 56.

The upper ends of bars 60 converge due to their angular disposition, and are secured at their upper ends to a generally horizontal bar 64 by means of a collar 66 or a similar arrangement, so as to be pivotable thereat. Bar 64 is telescopically length adjustable, having an outer sleeve 65, the adjustments being made by way of a forward collar 68. Collar 68 is secured to sleeve 65, the collar having a set screw 70 projecting therethrough. A rear collar 72, mounted behind collar 66 is used to set and hold the position of collar 66 on bar 64. Rear collar 72 is held in place on bar 64 with a set screw 74 substantially as is shown for collar 68. Mounted on the forward end of bar 64 is a generally U-shaped bracket member 76, through which connection is made to connecting bracket 16 which is mounted on the bicycle. A suitable means, such as bolt 78 shown in FIG. 1 is used to secure the bracket on the bicycle to the support means 10.

Figure 3:
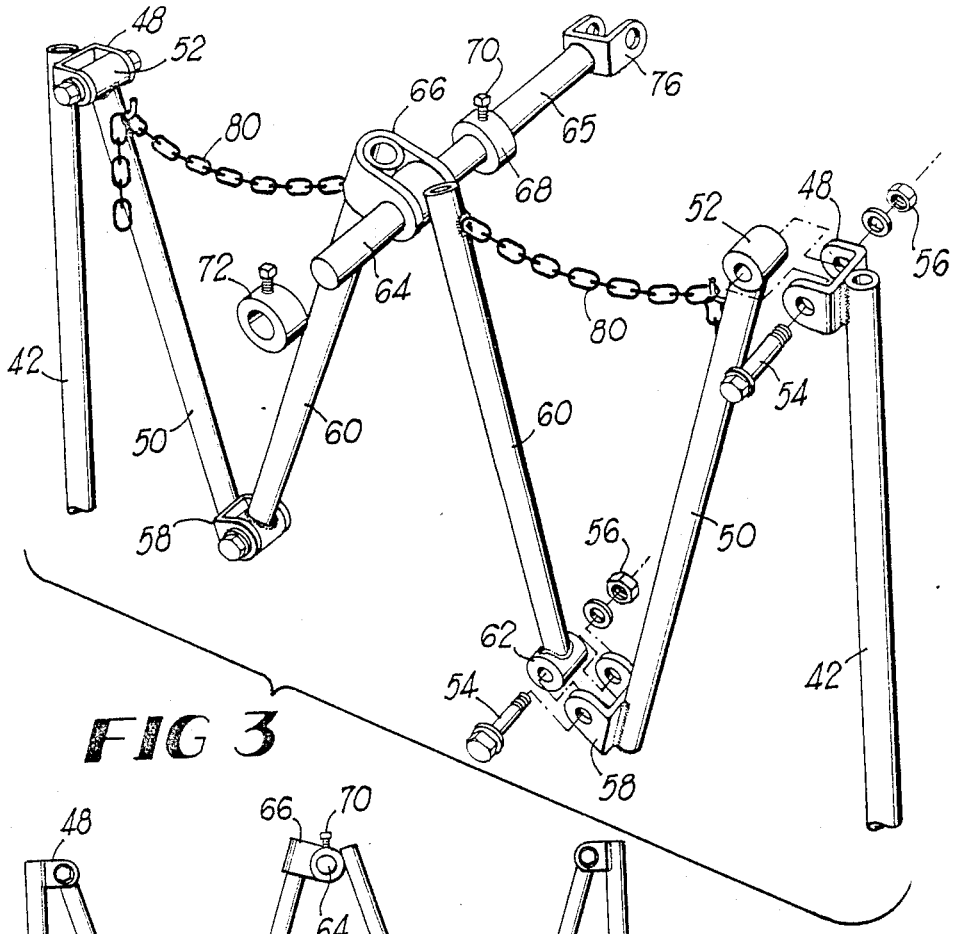
FIG. 3 is a exploded, perspective view of the support means used in the present invention to support the bicycle.
Figure 2:
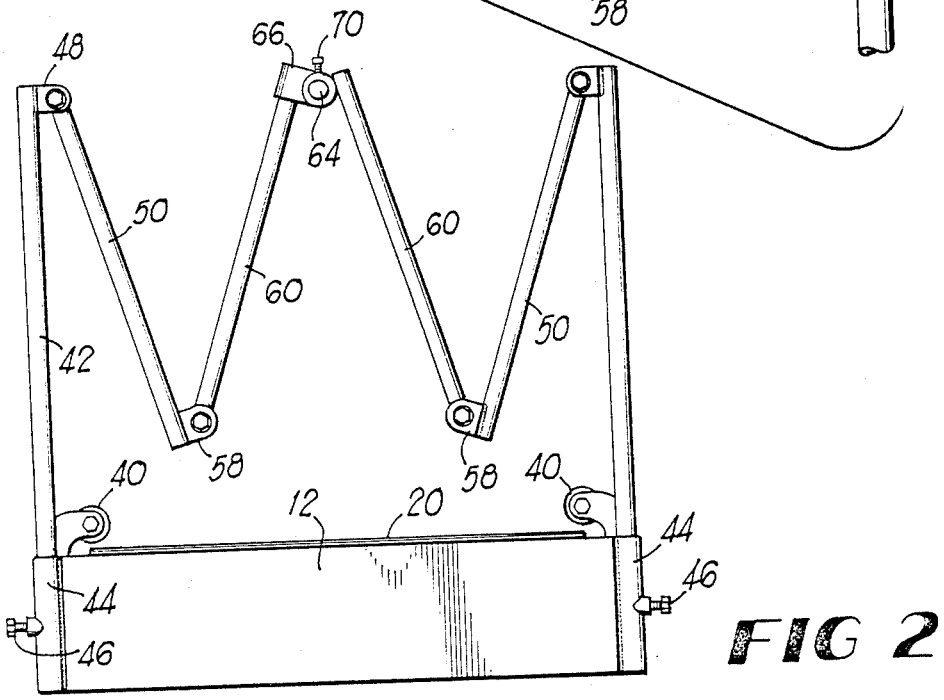
FIG. 2 is a rear elevational view of the support means shown in the preceding figure, shown here interconnected and ready to be attached to a bicycle.

As can be appreciated from FIGS. 2 and 3, the support means is formed as a pair of side-by-side V-shaped supports or lever arms, through which the central point, and hence the bicycle, may be moved laterally. The support means 10 thus is similar to an accordion-type arrangement whereby if the bicycle is moved to the right as viewed from the rear, for example, the V-shaped members on the right close while the members on the left open.

This arrangement provides substantial strength for maintaining the bicycle in a generally upright position during riding, while allowing freedom of movement from right to left and closely simulating actual riding conditions. A restraining means such as chains 80 is secured between the upper ends of bars 50 and 60 to limit the opening of the V. The chains have sufficient slack to enable realistic steering and tilting of the bicycle for training purposes, while limiting the tilting within safe limits without affecting the stability of the bicycle or rider.

In the use and operation of the present BICYCLE TRAINING AND EXERCISE DEVICE, a connecting bracket 16 is first secured to the bicycle in the region of the seat for mating connection with the support means 10. With the bracket secured to the bicycle, bracket 16 need only be connected to the generally U-shaped bracket 76 which is secured at the forward end of horizontal bar 64. With the connection secured, the bicycle may be ridden on the beltway 20 in substantially the same manner as the bicycle is ridden outdoors. To ride the bicycle outdoors, brackets 76 and 16 need only be disconnected from one another, and the bicycle taken off of the beltway 20.

While an embodiment of a BICYCLE TRAINING AND EXERCISE DEVICE has been shown and described in detail herein, various changes and modifications may be made without departing from the scope of the present invention.

I claim:

1. A bicycle training and exercise device comprising roller and beltway means for stationary operation of a bicycle thereon, right and left stanchion means disposed one to each side of the bicycle, a plurality of substantially rigid lever arms in side-by-side relationship, said arms being journaled together with bearing means for relative pivotal movement and secured to the bicycle and to said stanchion means, said lever arms also being laterally movable with respect to one another in response to lateral movements of the bicycle.

2. A bicycle training device as defined in claim 1 in which said stanchion means are disposed generally vertically and are vertically adjustable.

3. A bicycle training device as defined in claim 1 in which said lever arms are disposed to form side-by-side V-shaped members, with the central portion being releasably secured to the bicycle frame and the outermost end portions are respectively secured to said stanchion means.

4. A bicycle training device as defined in claim 3 and including restraining means secured to and extending between the open ends of said V-shaped members.

5. A bicycle training device as defined in claim 4 in which said device includes a generally horizontal, telescoping bar means secured at one end to said central portion and at the opposite end to the bicycle frame.

6. A bicycle training device as defined in claim 1 in which said bearing means are disposed at the points of connection of said lever arms to said stanchion means and at the points of connection between adjacent lever arms.

7. A bicycle training device as defined in claim 6 in which said stanchion means are disposed generally vertically and are vertically adjustable.

8. A bicycle training device as defined in claim 7 in which said lever arm means are disposed to form side-by-side V-shaped members, with the central portion being releasably secured to the bicycle frame and the outermost end portions are respectively secured to said stanchion means.

9. A bicycle training and exercise device for stationary operation of a bicycle having roller and beltway means upon which the bicycle is supported, wherein the improvement comprises stanchion means on each side of the bicycle, a plurality of lever arm means journalled together for relative pivotal movement and disposed to form side-by-side V-shaped members, said journalled arms having an inner central portion releasably secured to the bicycle frame and outer end portions respectively secured to said stanchion means for supporting the bicycle on the roller and beltway means, said lever arm means also being laterally movable with respect to one another in response to lateral movements of the bicycle.

10. A bicycle training device as defined in claim 9 in which said stanchion means are disposed generally vertically and are vertically adjustable.

11. A bicycle training device as defined in claim 9 and including restraining means secured to and extending between the open ends of said V-shaped members.

12. A bicycle training device as defined in claim 11 in which said device includes a generally horizontal, telescoping bar means secured at one end to said central portion and at the opposite end to the bicycle frame.

13. A bicycle training device as defined in claim 9 in which said lever arm means have self-aligning bearing means disposed at the points of connection of said lever arms to said stanchion means and at the points of connection between adjacent lever arms.

14. A bicycle training device as defined in claim 13 in which said stanchion means are disposed generally vertically and are vertically adjustable.

15. A bicycle training device as defined in claim 14 in which said lever arm means are disposed to form side-by-side V-shaped members, with the central portion being releasably secured to the bicycle frame and the outermost end portions are respectively secured to said stanchion means.

16. A bicycle training device as defined in claim 9 in which said device includes an elongated, telescoping bar means secured at one end to said lever arm means and at the opposite end to the bicycle frame.

17. A bicycle training device as defined in claim 16 in which said device includes side restraining means disposed generally parallel to and slightly above the beltway for preventing the bicycle wheels from leaving the beltway.

* * * * *